United States Patent [19]

Gall et al.

[11] Patent Number: 4,699,035

[45] Date of Patent: Oct. 13, 1987

[54] PERFORATING CUTTER

[75] Inventors: Ewald Gall, Remseck; Hans Weller, Fichtenberg, both of Fed. Rep. of Germany

[73] Assignee: Maschinenbau Oppenweiler Binder GmbH & Co., Fed. Rep. of Germany

[21] Appl. No.: 833,850

[22] Filed: Feb. 26, 1986

[30] Foreign Application Priority Data

Mar. 21, 1985 [DE] Fed. Rep. of Germany ..... 3510276

[51] Int. Cl.[4] ..... B26F 1/20

[52] U.S. Cl. ..... 83/678; 83/332; 83/346; 493/368

[58] Field of Search ..... 83/332, 678, 346, 345; 493/365, 367, 368, 370

[56] References Cited

U.S. PATENT DOCUMENTS

| | | | |
|---|---|---|---|
| 3,408,735 | 11/1968 | Eisler | 83/332 |
| 3,978,752 | 9/1976 | Meaden et al. | 83/678 |
| 3,978,753 | 9/1976 | Meaden et al. | 83/678 |
| 4,502,357 | 3/1985 | Hussissian | 83/332 |

FOREIGN PATENT DOCUMENTS 1561508 4/1970 Fed. Rep. of Germany .

*Primary Examiner*—E. R. Kazenske
*Assistant Examiner*—Hien H. Phan
*Attorney, Agent, or Firm*—John F. A. Earley; John F. A. Earley, III

[57] ABSTRACT

In order to adjust desired web lengths between perforations, a perforating cutter (6) is used which consists of two mutually rotatable cutter discs (10 and 11) which can be fixed in the adjusted positions relative to each other. One cutter disc (11) has thereby a flat radial cutting surface (12) which constitutes the base of a flat truncated cone, the lateral face (16) of which corresponds to the inner lateral face (15) of a pot-shaped cutter disc (10), of which the outer lateral face (14) forms, together with the cutting face (12), a cutting edge (19) at which also terminate the lateral face (16) of one cutter disc (11) and the inner lateral face (15) of the other cutter disc (10). Provided in the cutting edge (15) and around the periphery are regularly equidistant cutouts (24), of which the length and thus the length of the webs between the perforations can be adjusted by rotation of the cutter discs (10 and 11) in relation to each other.

9 Claims, 14 Drawing Figures

PERFORATING CUTTER

The invention relates to a perforating cutter adapted for rotationally rigid and axially lockable mounting on a cutter block spindle and taking the form of a flat annular disc having two plane-parallel end faces, a cylindrical inner face and an outer face in the form of a straight frustoconical shell, the base of which is the end face of the disc which forms the cutting surface and which, at its line of intersection with the outer surface, forms a cutting edge provided with equidistantly spaced apart cut-outs (DOS No. 1 561 508).

In folding machines, further processing frequently requires perforation, for example in the case of adhesive bindings, for tear-off perforations or in order to allow air to escape so that the sheets can fit together without creases forming. In the case of folding machines with folding pockets, perforation normally takes place after the parallel crease or, in the case of combination machines, after each knife fold. According to paper quality or the nature of the paper, so every possible variation of perforating cutter is used, offering various numbers of teeth and differing land widths. The perforating cutter is rotationally rigidly mounted on a cutter block spindle and is fixed axially by stop nuts which can be locked on the cutter block spindle. Serving as the cutting edge is a mating cutter which is usually the end face of a cutter block. In order to be able to carry out the most widely diverse types of perforation, the perforating cutters have to be changed. In spite of the many types of perforating cutter available, it can happen that the cutter required for the desired perforation is not available.

The problem on which the invention is based resides therefore in so developing the perforating cutter of the type mentioned at the outset that it is possible by simple means and without considerable complication to adjust it in such a way that the perforation desired can be performed.

On a basis of the perforating cutter of the type mentioned at the outset, this problem is resolved in that starting from its inner cylindrical face, the annular disc is sub-divided along a plane parallel with the end faces and an inner lateral face of the cone extending from the cutting edge between one end face and the outer face of this plane, into two fittingly adjacently disposable cutter discs which are adapted to rotate in respect of each other and to be locked in the position to which they are adjusted.

Therefore, the perforating cutter according to the invention consists of a first cutter disc having the form of a truncated cone of very low height and large cone angle, and of a second cutter disc which is pot-shaped, the cavity taking the form of a hollow truncated cone into which the truncated conical shape of the first cutter disc fits exactly, the pot rim of the second cutter disc, defined by the lateral faces of the cone and after insertion of the first cutter disc forming with this latter a common cutting edge. In the peripheral surface of the cutting edge which is thus formed are the regularly spaced apart cut-outs as a result of which the webs of paper are left between the perforations which have to be formed. If it becomes necessary to alter the web length, then the cutters have to be rotated in respect of each other and out of the position in which the cut-outs coincide, until such time as the desired shorter web length is attained, the discs then being fixed in this position relative to one another. Thus it is possible to avoid complicated exchange of the different perforating cutters of the prior art. Furthermore, it is necessary to maintain the otherwise customary stock of cutters.

Manufacture of the perforating cutter according to the invention is particularly simple if the circular lines of intersection of the outer end face and of the inner end faces of the two cutter discs formed by the separation along the plane parallel with the end faces lie on a common cylindrical face with the associated lateral faces of the cone, in other words if the bend in the end faces into the lateral faces of the conical shell are provided at equal radial distances.

In order to have identical cutter thicknesses for reasons of strength, the angle between the cutting face and the inner lateral face of the conical shell of one cutter disc and between the inner and the outer lateral face of the conical shell is identical. To achieve a good cutting action, this angle is in each case 10° to 20° and is preferably 15°.

Fixing of the adjusted relative location of the cutter and centring of the cutter are particularly simple to perform if an annular disc is provided which has a cylindrical axial projection for centring and receiving the two cutter discs and a mating disc. In this case, one cutter disc has its flat cutting face bearing on the annular disc. There is in the mating ring at least one bore, at least one elongated hole being provided in the abutting face of the cutter disc while in the other cutter disc there is at least one bore or one elongated hole while the annular disc comprises at least one screwthreaded bore to receive a setscrew.

Adjustment of the cutter discs in relation to each other is particularly simple if at least one positioning aperture is constructed in the mating ring and if an associated adjusting slot is constructed at least in that cutter disc which bears on its end face.

An example of embodiment of the invention is explained in greater detail hereinafter with reference to the accompanying drawings, in which.

Figure 2:
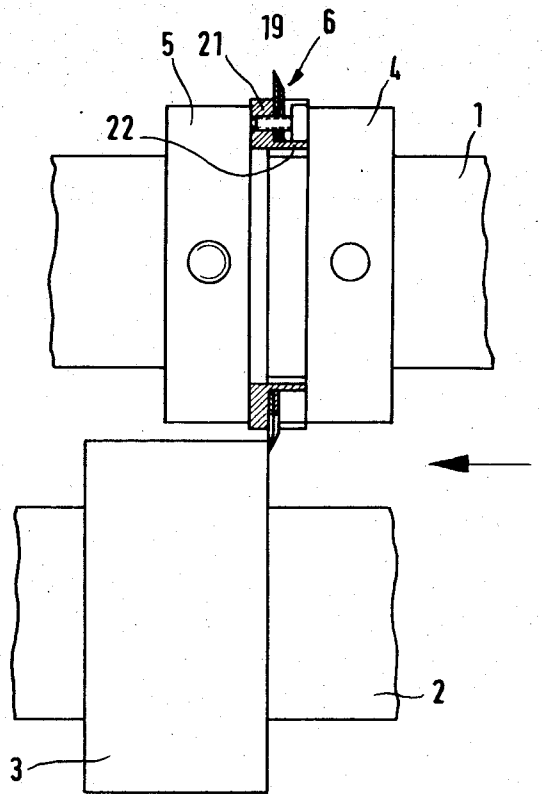
FIG. 2 shows in detail and in plan view the two cutter block spindles with perforating cutter and counter cutter.
Figure 1:
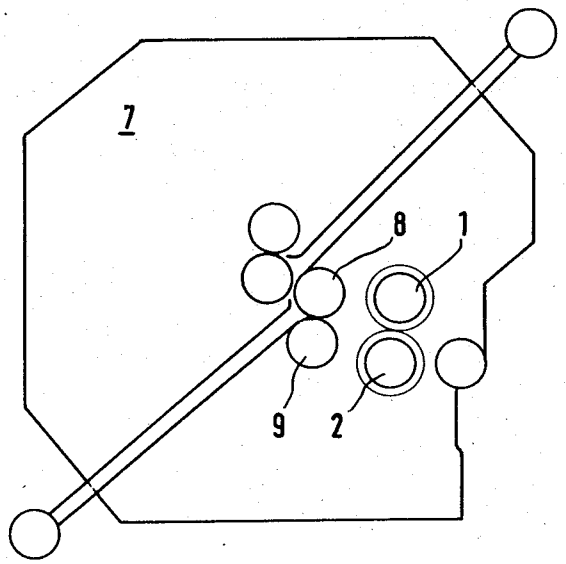
FIG. 1 shows diagrammatically and in a side view a folding machine having on the downstream side a perforating cutter.

The folding machine 7 shown in FIG. 1 has folding cylinders and folding pockets. Downstream of the discharge rollers 8 and 9 is a pair of cutter block spindles 1 and 2 of which the cutter block spindle 1 carries a perforating cutter 6 while the cutter block spindle 2 carries a counter cutter 3. The perforating cutter 6 is mounted in rotationally rigid manner on the cutter block spindle 1 and is fixed in the axial position by cutter retaining nuts 4 and 5 which are fixed on the cutter block spindle 1 by radially extending grub screws. Cooperating with the cutting face of the perforating cutter 6 is a counter cutter 3 mounted on the cutter block spindle 2 and which consists of the end face of a cutter block (FIG. 2).

As can be seen in FIGS. 3 to 5 and 10 to 14, the perforating cutter consists of a first cutter disc 11 and a second cutter disc 10. The first cutter disc 11 has lying in a radial plane an end face which constitutes the cutting face 12 and an inner end face 18. The cutting face 12 forms the base surface of a very flat truncated cone, of which the lateral surface 16 forms with the cutting face 12 the angle $\alpha/2$ which amounts to 15°.

Figure 5:
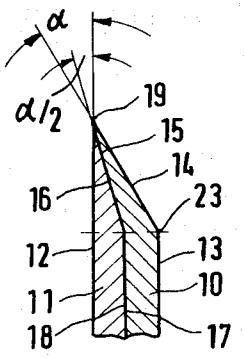
FIG. 5 is a radial section through the perforating cutter in the region of the cutting edge.

The second cutter disc 10 has an inner end face 17 and an outer end face 13 which extend radially as far as the radial end face 18 of the first cutter disc 11, in other words all end in a face of the cylinder designated 23 in FIG. 5. The inner end face 17 of the second cutter disc 10 is angled over to form an inner lateral face 15 of the conical shell so that the first cutter disc 11 fits exactly into the second cutter disc 10 which forms a hollow truncated cone. The outer end face 13 of the second cutter disc 10 has an outer lateral face 14 of the conical shell. The inner face 15 and the outer face 14 of the second cutter disc 10 and the inner face 16 and the cutter face 12 of the first cutter disc 11 terminate in one and the same cutting edge 19. The angle between the inner face 15 and the outer face 14 of the second cutter disc 15 is likewise $\alpha/2$ and in the case of the example of the embodiment shown, it is 15° so that the angle between the cutting face 12 and the outer face 14 of the second cutter disc 10 is 30°.

Figure 4:
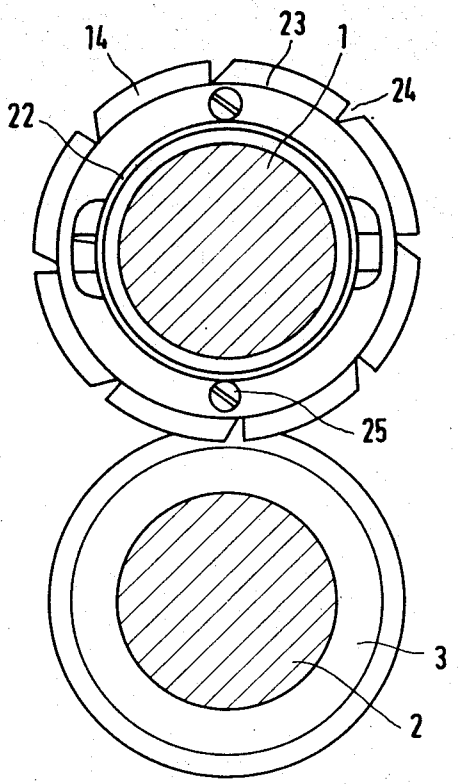
FIG. 4 is a view similar to FIG. 3 showing the cutter discs in an aligned orientation.
Figure 3:
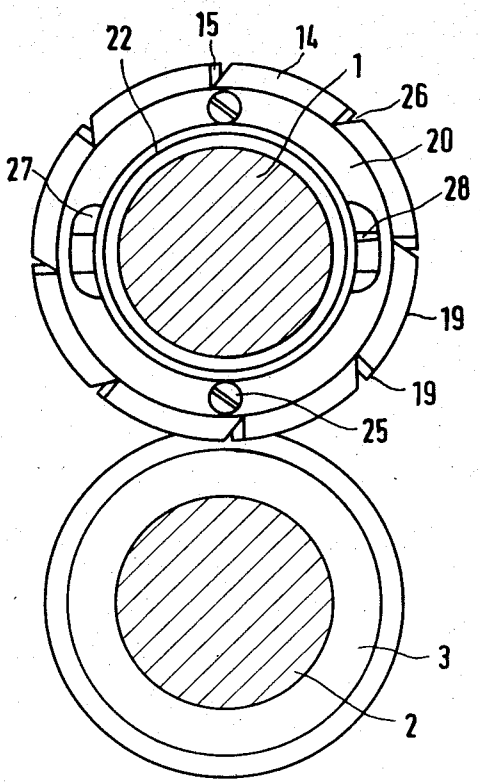
FIG. 3 is a view in the direction of the arrow in FIG. 2 with mutually adjusted cutter discs of the perforating cutter.
Figure 6:
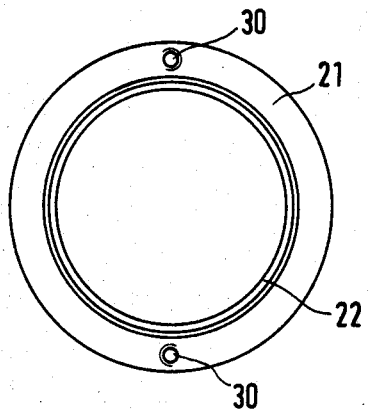
FIG. 6 is a plan view of the annular disc.
Figure 7:
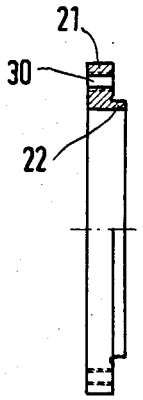
FIG. 7 is an axial section through the annular disc.
Figure 8:
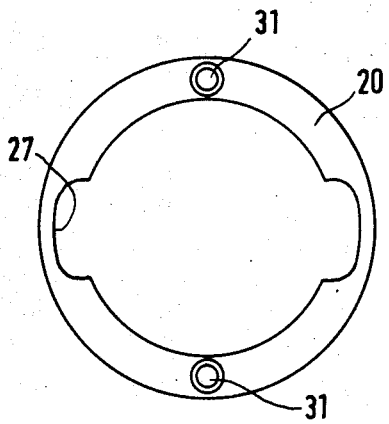
FIG. 8 is a plan view of the mating ring.
Figure 9:
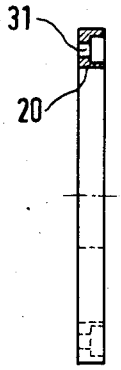
FIG. 9 shows an axial section through the mating ring.
Figure 10:
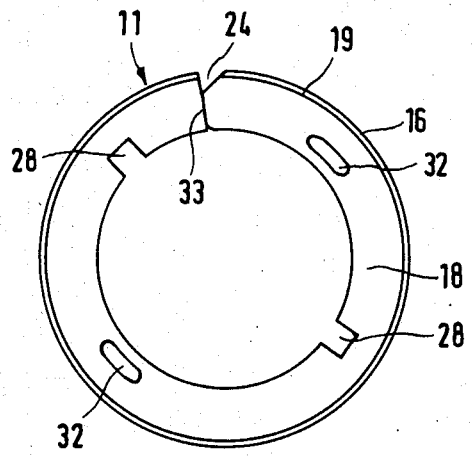
FIG. 10 is a plan view of the cutter disc comprising the cutting face.
Figure 11:
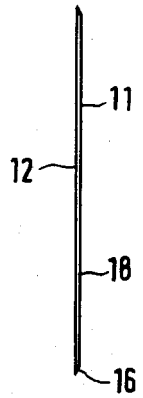
FIG. 11 is a side view of the cutter disc in FIG. 10.

As can be seen from FIGS. 3 and 4, there are constructed at equal intervals in the circular cutting edge 19 eight cut-outs 24 which in FIG. 4 are shown in a coincident relationship. The cutter discs 10 and 11 can be rotated relative to each other so that the cutter portions and thus the perforations can be lengthened, if the cutter discs 10, 11 are positioned as shown in FIG. 3 so that in consequence shortened webs remain in the paper, corresponding to the spaces 26 which remain.

As can be seen from FIGS. 3 and 4 and also from FIGS. 6 to 9, for centring mounting of the cylindrical inner faces of the two cutter discs 10 and 11 of the perforating cutter 6, a cylindrical axially extending projection 22 is provided on an annular disc 21 which has two diametrically opposed screw-threaded bores 30. The cutter disc 11 is so pushed onto the projection 22 that its cutting face 12 bears on the annular disc 21. Then the pot-shaped cutter disc 10 is so pushed onto the projection 22 that the truncated cone of the cutter disc 11 fits into the hollow frustoconical surface of the cutter disc 10 resulting in the two cutter discs 11 and 10 constituting the perforating cutter 6. The cutter disc 11 includes two diametrically opposed elongated holes 32 while the cutter disc 10 likewise has two diametrically opposed elongated holes 35, as can be seen from FIGS. 10 and 12. The perforating cutter comprising the cutter discs 10 and 11 and positioned in this way on the projection 22 then has associated with it a mating ring 20 which can likewise be pushed onto the projection 22 and which comprises two diametrically opposed bores 31. Setscrews 25 (FIGS. 3 and 4) are then passed through the bores 31 in the mating ring, the elongated holes 35 in the pot-shaped cutter disc 10 and the elongated holes 32 in the cutter disc 11 and are screwed into the threaded bores 30 in the annular disc 21 so that the cutter discs 10 and 11 are pressed firmly against each other so that their relative position in relation to each other can no longer be varied.

Figure 12:
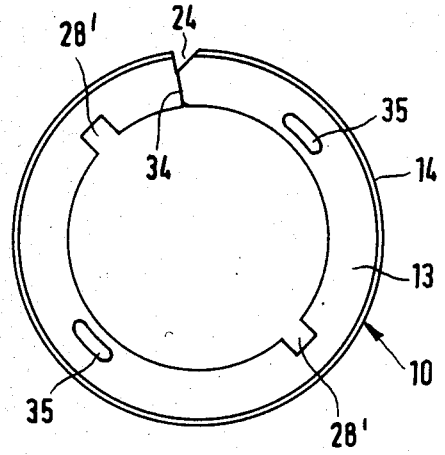
FIG. 12 is a plan view of the pot-shaped cutter disc.
Figure 13:
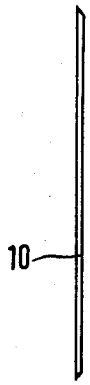
FIG. 13 is a side view of the pot-shaped cutter disc.
Figure 14:
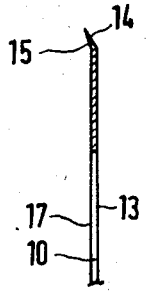
FIG. 14 is an axial sectional view of the pot-shaped cutter disc.

For varying the relative position of the cutter discs 10 and 11 when the setscrews 25 are slackened, in order to be able to adjust, for instance, from the aligned cutter position shown in FIG. 4 to a cutter position as shown in FIG. 3, there are provided in the mating ring 20 two diametrically oppositely disposed adjusting apertures 27 which are staggered by 90° in respect of the bores 31. Provided in the pot-shaped cutter disc 10 are two diametrically oppositely disposed adjusting slots 28′ which are likewise offset by 90° in relation to the centres of the elongated holes 35, as is shown in FIG. 12. There are in the cutter disc 11 likewise two adjusting slots 28 of which one is removed by 90° from the centres of the elongated holes 32 while the other is offset by an angle of, for instance, 15° in relation to the diametral opposition to the other slot and towards an elongated hole 32, this angle being related to the peripheral centre of the adjusting slot 28.

In order to adjust the cutter discs 10 and 11 in respect to each other to adjust the desired perforation, a suitable instrument, for example a screwdriver, is inserted through the adjusting aperture 27 in the mating ring 20 between the adjusting slots 28 and 28′ and the desired adjustment of the cutter discs 10 and 11 in relation to each other is performed. Tightening the setscrews 25 fixes the setting which has been made. In order to be able to carry out this adjustment, it is only necessary for one cutter retainer nut to be slackened and moved axially.

The cutter disc 11 has a radial cut 33, extending to the base of one cut-out 24, while the cutter disc 10 has a corresponding cut 34, allowing the cutter discs 11 and 10 to perform a somewhat resilient movement in their peripheral direction.

What is claimed is:

1. A perforating knife or cutter assembly for perforating material comprising a first annular knife having an outer end portion having a first face and a second face, the first face being flat and having an outer edge, the second face having a truncated cone shape by being angled towards and meeting the first face at the outer edge of the first face to form a cutting edge of the first knife, the first knife cutting edge having at least one gap or cut-out section, a second annular knife having an outer end portion having a first face and a second face, the first face of the second knife outer end portion having an outer edge and being angled to form a truncated cone dimensioned to receive the second face of the first knife outer end portion, the second face of the second knife outer end portion being angled to form another truncated cone, the first and second faces of the second knife outer end portion meeting at the outer edge of the first face of the second knife outer end portion to form a cutting edge of the second knife, the second knife cutting edge having at least one gap or cut-out section, and means for adjustably securing the second face of the first knife outer end portion to the first face of the second knife outer end portion to form a cutting edge of the knife assembly where the outer edge of the first knife meets the outer edge of the second knife, the gap of the first knife cutting edge being adjustably alignable with the gap of the second knife cutting edge to produce a desired combined gap which corresponds to the length of the ties between perforations to be made by the knife assembly.

2. The perforating knife assembly of claim 1, the cutting edges of the first and second knives each having a plurality of regularly spaced gaps, whereby the length of the combined gaps formed by the overlap of the gaps of the first knife with the gaps of the second knife may be adjusted by rotation of the first and second knives relative to each other.

3. The perforating knife assembly of claim 1, the first knife having an inner end portion having a first planar face and a second planar face, the first planar face and the second planar face of the inner end portion being parallel to each other, the second knife having an inner end portion having a first planar face and a second planar face, the first planar face of the second knife inner end portion being in a plane parallel to the first and second planar faces of the first knife inner end portion when the first knife is secured to the second knife, and the plane of the first and second planar faces of the first knife inner end portion and the first planar face of the second knife inner end portion defining circular lines of intersection with the second face of the first knife outer end portion and the first face of the second knife outer end portion.

4. The perforating knife assembly of claim 1, the angle between the first and second faces of the first knife outer end portion being the same as the angle between the first and second faces of the second knife outer end portion.

5. The perforating knife assembly of claim 4, the angle being in the range of 10 to 20 degrees.

6. The perforating knife assembly of claim 4, the angle being 15 degrees.

7. The perforating knife assembly of claim 1, the securing means including an annular disk having a cylindrical axial projection or collar for receiving the first and second knives, a mating ring having at least one bore, the first knife having at least one elongated hole, the second knife having at least one bore or elongated hole, the annular disk having at least one threaded bore adapted to accommodate a set screw, and a set screw for securing the knife assembly together extending through the bore in the mating ring, the bore or elongated hole in the second knife, the elongated hole in the first knife, and the threaded bore in the annular disk.

8. The perforating knife assembly of claim 7, the mating ring being provided with at least one adjusting aperture, and the second knife having at least one adjusting slot which corresponds to the mating ring adjusting aperture.

9. A perforating knife or cutter assembly for perforating material comprising a first annular knife having an outer end portion having a first face and a second face, the first face being flat and having an outer edge, the second face having a truncated cone shape by being angled towards and meeting the first face at the outer edge of the first face to form a cutting edge of the first knife, the first knife cutting edge having at least one gap or cut-out section, a second annular knife having an outer end portion having a first face and a second face, the first face of the second knife outer end portion having an outer edge and being angled to form a truncated cone dimensioned to receive the second face of the first knife outer end portion, the second face of the second knife outer end portion being angled to form another truncated cone, the first and second faces of the second knife outer end portion meeting at the outer edge of the first face of the second knife outer end portion to form a cutting edge of the second knife, the second knife cutting edge having at least one gap or cut-out section, and means for adjustably securing the second face of the first knife outer end portion to the first face of the second knife outer end portion to form a cutting edge of the knife assembly where the outer edge of the first knife meets the outer edge of the second knife, the gap of the first knife cutting edge being adjustably alignable with the gap of the second knife cutting edge to produce a desired combined gap which corresponds to the length of the ties between perforations to be made by the knife assembly, the cutting edges of the first and second knives each having a plurality of regularly spaced gaps, whereby the length of the combined gaps formed by the overlap of the gaps of the first knife with the gaps of the second knife may be adjusted by rotation of the first and second knives relative to each other, the first knife having an inner end portion having a first planar face and a second planar face, the first planar face and the second planar face of the inner end portion being parallel to each other, the second knife having an inner end portion having a first planar face and a second planar face, the first planar face of the second knife inner end portion being in a plane parallel to the first and second planar faces of the first knife inner end portion when the first knife is secured to the second knife, and the planes of the first and second planar faces of the first knife inner end portion and the first planar face of the second knife inner end portion defining circular lines of intersection with the second face of the first knife outer end portion and the first face of the second knife outer end portion, the angle between the first and second faces of the first knife outer end portion being the same as the angle between the first and second faces of the second knife outer end portion, the angle being 15 degrees, the securing means including an annular disk having a cylindrical axial projection or collar for receiving the first and second knives, a mating ring having at least one bore, the first knife having at least one elongated hole, the second knife having at least one bore or elongated hole, the annular disk having at least one threaded bore adapted to accommodate a set screw, and a set screw for securing the knife assembly together extending through the bore in the mating ring, the bore or elongated hole in the second knife, the elongated hole in the first knife, and the threaded bore in the annular disk, the mating ring being provided with at least one adjusting aperture, and the second knife having at least one adjusting slot which corresponds to the mating ring adjusting aperture.

* * * * *